United States Patent [19]

Cook

[11] 4,221,618

[45] Sep. 9, 1980

[54] SLURRY EXPLOSIVES

[76] Inventor: Melvin A. Cook, 2026 Beneficial Life Tower, Salt Lake City, Utah 84111

[21] Appl. No.: 11,153

[22] Filed: Feb. 9, 1979

[51] Int. Cl.[2] ..... C06B 45/02

[52] U.S. Cl. ..... 149/21; 149/60; 149/61; 149/76; 149/92; 149/105

[58] Field of Search ..... 149/60, 61, 21, 92, 149/76, 112, 105, 113

[56] References Cited

U.S. PATENT DOCUMENTS

| | | | |
|---|---|---|---|
| 3,685,163 | 8/1972 | Olt | 149/113 X |
| 3,892,610 | 7/1975 | Huzinec | 149/113 X |
| 3,954,526 | 5/1976 | Mangum et al. | 149/113 X |

*Primary Examiner*—Stephen J. Lechert, Jr.

*Attorney, Agent, or Firm*—Thos. A. Wilson

[57] ABSTRACT

This invention relates to Cold-Formulated Slurry Explosives with Ultra-Fine Oxidizer Solids and including perchlorates.

15 Claims, No Drawings

SLURRY EXPLOSIVES

The present invention relates to new and improved cold-formulated slurry explosives containing colloidal ammonium perchlorate, and/or other collodial (ultra-fine) oxidizers.

The invention may be more readily understood by considering the following definitions and abbreviations to be used throughout the specification and claims.

DEFINITIONS AND ABBREVIATIONS

Slurry: A state of matter comprising a dispersion and a disperse phase. The dispersion phase is a continuous liquid, and the disperse phase comprises suspended solids and in some cases insoluble liquids. The dispersion phase of slurry explosives is in general a thickened and gelled aqueous oxidizer solution saturated with ammonium nitrate and usually sodium nitrate, often also containing other solutes. The disperse phase is generally rich in AN and usually contains other particulate solids and in some cases insoluble liquids.

Slurry Explosive: Here called "Explosive Surry" abbreviated "ES" to emphasize that this invention pertains largely to the slurry state. Specific types are abbreviated:

CFES: Cold-formulated explosive slurry (formulated at ambient temperatures AT).

HFES: Hot-formulated explosive slurry of prior art (formulated by adding all ingredients to a hot oxidizer solution).

To designate a particular type, the sensitizer is affixed as follows: FO-CFES means fuel oil-sensitized CFES; gil-CFES means gilsonite-sensitized CFES, etc. FO-HFES means fuel oil-sensitized HFES, etc.

AN: Ammonium nitrate; $AN_2$(aq): saturated aqueous solution of AN; CAN: coarse AN; FAN: fine AN; UFAN; ultra-fine AN; AP: ammonium perchlorate; UFAP: ultra-fine AP; (AP is essentially "salted out" of the cold dispersion phase by the common ion effect); FO: fuel oil; MA: methyl alcohol; NaP: sodium perchlorate; NaP(aq): aqueous NaP solution; 60 NaP(aq): 60% NaP(aq); SN: sodium nitrate; SN(aq): aqueous solution of SN; $AN_s$/SN(aq): aqueous solution saturated with AN but not SN; $AN_s$/$SN_s$(aq): aqueous solution saturated with AN and SN; FSN: fine SN; UFSN: ultra-fine SN.

CFOS and HFOS are unsensitized oxidizer slurries made in the cold-formulation and hot-formulation methods, respectively.

Slurry Point: (Designated $V_o$[1]) the minimum dispersion phase required to maintain the slurry state, i.e., to maintain continuity of the dispersion phase. (Slurry point is discussed on pages 280–285, *The Science of Industrial Explosives,* IRECO, Slat Lake City, 1974.)

$V_1$: volume percent dispersion phase; $V_2$: volume percent disperse phase ($V_1+V_2=100$).

Sensitiveness Test: This is a propagation ("go, no go") test used herein to compare the cold-formulated products of this invention with the hot-formulated ones of prior art and thus the relative sensitiveness by the criterion of critical density at constant charge diameter and temperature. It consists of firing (usually) a 30-pound charge packaged in 5" diameter (d) polyethylene (thus having a length [L] of 35±5") with a "booster" after measuring charge density ($\rho$-g/cc by weighing in and out of water) and temperature (°C.). The result is recorded as "D$-\rho$(t, age in days)" if the charge propagates the detonation wave completely, or as F$-\rho$(t, age) if part of the charge is left undetonated.

The booster used in this sensitiveness test was a commercial 2"(d)×4"(L) cast pentolite booster for blasting agents, i.e., explosives such as the CFES of this invention that will not detonate with a blasting cap alone and which contain no explosive ingredients per se.

Critical Density ($\rho_c$): The maximum $\rho$ for consistent detonations at or below which no F's are observed. (Some D's may be observed at $\rho>\rho_c$.) If $\rho_c$ has not been determined, or to illustrate whether or not a particular charge has a sensitiveness above or below a particular level, a result of only one or two sensitiveness tests may be shown by listing an observed "D$-\rho$(t, age)", of "F$-\rho$(t, age)." In examples where critical diameter has been determined by a sufficient number of tests, the sensitiveness-test results are summarized by a $\rho_c$(t), $\rho_c$ being approximately a linear function of the temperature of the charge at the time of firing, i.e., $\rho_c \doteq \rho(0°)+0.007t$ for $\rho_c$ in grams/cc and t in °C.

PRIOR ART

NaP and AP are often mentioned in patent literature as oxidizers for slurry explosives along with AN, SN, and "other inorganic oxidizers." To be sure, NaP(aq) has been used with AN solutions but in smaller amounts and in different ways than dictated by the metathesis method of this invention, as described below. The first HFES patent to mention prchlorates was U.S. Pat. No. 3,096,223 (present inventor a patentee). NaP and AN were not used together in this case. U.S. Pat. No. 3,249,476 shows NaP, NaP/SN, and AP/SN as examples of salts useful in lowering fudge points of hot solutions but nothing to indicate the use of NaP(aq)/AN in the composition and manner to accomplish the purposes of this invention. U.S. Pat. No. 3,282,753 (present inventor a patentee) not only does not contemplate the metathesis reaction but has a water limitation inconsistent with the present invention. Slurry explosive patents often list many oxidizers including perchlorates and AN but with no evidence of contemplation of the NaP/AN metathesis for CFES. Examples include U.S. Pat. Nos. 3,318,740; 3,431,155; 3,485,686; 3,507,718; 3,522,117; 3,695,950; 3,727,350; and 3,985,593. U.S. Pat. No. 3,465,675 made allowance for AN-chlorate and perchlorate reactions by specifying that the nitrates on the one hand and chlorates and perchlorates on the other be used separately. The patent and other literature of public domain do not address the important problem of formulating the disperse phase to maximize sensitiveness in the ways described herein, i.e., using colloidal or ultra-fine oxidizer salts.

"OXIDIZER SLURRY" OR "OS" COMPONENTS OF CFES AND HFES $AN_s$/$SN_s$(aq) and $AN_s$/SN(aq) are preferred oxidizer solutions for the disperse phase of both CFES and HFES. They have been used extensively since the beginning of the slurry explosives industry being claimed in the first patent of this era (U.S. Pat. No. 2,930,685). They are generally thickened by guar gum and gelled with a suitable cross-linking agent. Hydroxypropyl guar gum cross-linked with potassium (pyro)antimonate at 20/1 gum/cross-linker is a preferred thickening and cross-linking system and the one used in examples given herein.

An object of the present invention is improved and cold-formulated slurry explosives with ultra-fine oxidizer solids.

Further objects will be appreciated from the following description of the invention:

This invention relates to improved slurry explosives with the solids (or disperse) phase consisting of ultra-fine (colloidal) ammonium perchlorate, (usually) a small amount of ultra-fine sodium nitrate, ammonium nitrate which may be coarse, fine, or ultra-fine, or combinations thereof. The ultra-fine ammonium perchlorate and sodium nitrate are made by a metathesis reaction and ultra-fine ammonium nitrate by (colloid) milling. The fine ammonium nitrate is made by grinding or by recrystallization from a hot concentrated solution fortified with crystal-growth inhibitors. What combination of ultra-fine, fine and coarse ammonium nitrate is used depends on the sensitiveness level desired. The metathesis here used is between aqueous sodium perchlorate and solid ammonium nitrate prills using enough excess of the latter to saturate the water of the reactant solution and, in case only coarse ammonium nitrate is needed, to provide all the undissolved ammonium nitrate. In the metathesis reaction the sensitizer fuel, thickener, and other ingredients except the gelling and density-control agents may be added along with the solid ammonium nitrate. The products of the methathesis are a dispersion phase made from the water of the reactant solution saturated with ammonium nitrate and sodium nitrate, with some, though very little, ammonium perchlorate and a disperse phase of ultra-fine ammonium perchlorate, usually a small amount of ultra-fine sodium nitrate, and a major portion of ammonium nitrate. When the ammonium perchlorate is present in an amount above about 18%, the ammonium nitrate of the disperse phase may be all coarse; but at lower amounts of ammonium perchlorate, from part to all of the solid ammonium nitrate constituent should be fine depending on the sensitiveness level desired which, of course, depends also on the sensitizer used.

Slurry explosives cold-formulated by the above metathesis reaction and containing coarse, fine, or ultra-fine ammonium nitrate have significant advantages over those of prior art including faster detonation reactions with a corresponding appreciable increase in sensitiveness (which generally means appreciably better blasting action), lower production and sensitizer costs, greater ease of mixing and packaged slurry quality. Lower costs of production are associated with simplicity of mixing and no need for the conventional hot-formulation and hot-storage facilities generally used in the slurry explosives of prior art. Lower sensitizer costs are associated with the ability of the cold-formulated slurry explosives of this invention to use economical and technically desirable sensitizers either not applicable at all or only marginally effective as sensitizers for the slurry explosives of prior art. By packaged slurry quality is meant not only adequate, time-independent sensitiveness but also high-quality physical properties (softness, stable and tight gel structure, water resistance, high enough density to sink in water-filled boreholes, and long "shelf life").

SN is a preferred constituent of the dispersion phase, not because it is a better oxidizer than AN (it is actually not as good and is more expensive), but because it contributes important qualities: (a) For a given amount of water, $SN_s$(aq) adds (approximately) 0.27 times the volume of the water component at 0° C. and 0.36 times that at 30° C. in addition to (approximately) 0.75 and 1.54 times the volume of the water component contributed by AN at 0° and 30° C., respectively. Thus $AN_s/SN_s$(aq) has a volume (approximately) 2.02 times as great as that of its water constituent at 0° C. and 2.93 times as great at 30° C. The corresponding weight ratios are (approximately) 0.73 and 0.88 for SN, and 2.91 and 4.38 for (AN+SN+water)/water at 0° C. and 30° C., respectively, with approximately a linear variation between. These values were computed using the (evidently good) approximation that each salt has the same saturation concentration in $AN_s/SN_s$(aq) as in $AN_s$(aq) and $SN_s$(aq) separately. The effective (saturation) densities assumed in these approximations were 1.57 g/cc for AN, 2.7 g/cc for SN, 2.5 for calcium nitrate (CN), and 0.8 for methanol in $AN_s/SN_s$(aq) based on the saturated AN(aq) and $SN_s$(aq) solutions. Densities in the disperse phase were those listed for the pure substances, namely, 1.725 g/cc for AN (1.69 g/cc for $t>32°$ C.), 1.95 for AP, 2.26 for SN, and 1.08 for gilsonite. (b) SN(aq) and $SN_s$(aq) inhibit crystal growth of AN in the disperse phase of CFES and HFES but appear to do so best with some SN in the disperse phase. (c) SN increases the density of the dispersion phase making it easier to disperse the solids (mostly AN) than in $AN_s$(aq) alone.

Slurry point is an important quantity in CFES design. $V^0{}_1$ usually falls in the range $40<V^0{}_1<60$ often at or near the lower limit. It varies with temperature, so a CFES having, for example, $V_1(20°)=60$ may have $V_1(0°)$ as low as 50; or with $V_1(20°)=50$, the $V_1(0°)$ may be as low as 42. Minimizing $V^0{}_1$ also minimizes the water requirements. Enough leeway should be provided in the difference $V_1-V^0{}_1$ so it will always be positive and CFES will retain the slurry state at all AT's. To minimize $V^0{}_1$, experience in casting "amatols" may be used wherein molten TNT is the dispersion phase and AN comprises the disperse phase. (This slurry state undergoes a transition to a "cast" when the TNT solidifies.) With an optimumly blended AN, particle size distribution $V^0{}_1$ is about 40 in the AN/molten TNT slury making it possible to cast a 60/40 (AN/TNT) "amatol." With less than ideal blending, a 50/50 amatol is obtained, but with very poor blending the AN/TNT ratio may go as low as 40/60. The situation is essentially the same in CFES and HFES; when the disperse phase has the proper particle size distribution and the densities of the two phases are close together, as in the AN/molten TNT slurry, $V_1{}^o$ *may be as low as* 40. But in less favorable circumstances it may go as high as 60. When $AN_s/SN_s$(aq) is used as the dispersion phase and UFAP (with some UFSN) together with CAN or a combination of CAN and FAN in the disperse phase, $V_1{}^o$ may be as low as 40.

How low in $V_1$ the slurry explosive should be formulated depends on the difference in AT between that at which the CFES is formed and the lowest AT anticipated in storage and use. It would be proper to make CFES only slightly greater than $V_1{}^o$ if the formulation and use or storage ATs are the same or if the former AT is below the use or storage temperature. If the difference $V_1-V_1{}^o$ is permitted to become negative, the slurry state will be destroyed and with it the gel stability which may not be restored when $V_1-V_1{}^o$ again becomes positive.

SLURRY FEATURES OF "OXIDIZER SLURRIES"

The essential physical properties of CFES of this invention as well as the HFES of prior art are determined largely by the oxidizer slurry or "OS" component. Four types of OS are thus considered before examples of CFES are given:

CFOS: This designation pertains to the OS of this invention most easily formulated with nearly all the desired properties ready for sensitization, namely, the product of the 60NaP(aq)/AN metathesis. At the 30/70 ratio CFOS is easily formed at say 20° C. (and is still in the slurry state at zero °C.) simply by stirring AN prills into the NaP(aq). The computed properties of this CFOS at the 30/70 ratio [taking AP(aq) as negligible, as seems to be the case] were: $V_1(20°)=50.4$ and $V_1(0°)=40.2$, $AN_s/SN_s(aq)=23.0/10.6/12$ and 14.3/8.8/12/AN/SN/water at 20° and 0°, respectively, and the disperse phase is about 17.3/1.9/35.2 UFAP-/UFSN/CAN and 17.3/1.9/35.2/1.8/8.8 UFAP-/UFSN/CAN/FSN/FAN at 20° and 0° C., respectively for the procuct formed at 20° C. This is an ideal OS system for several reasons: (a) The 60NaP(aq) is the product available at the lowest (contained NaP) cost. (The 60–64% product is the one that is shipped but for standardization purposes solutions above 60% might be diluted to say 60%, or possibly to as low as 58% in order to produce $AN_s/SN_s(aq)$ with a minimum UFSN.) (b) The density of both the reactant and the product solutions are ideal for the use of AN prills (immersion density about 1.45 g/cc due to locked-in aeration released when AN dissolves) so the prills will float to make easy mixing of the 60NaP(aq)/AN reactants. (c) The product (CFOS) is as easy to form (as is the corresponding CFES) as an HFOS (or corresponding HFES) but has the advantage of being at or very near to AT when formulation is complete because the sensitizer, thickener, and other ingredients may easily be added right along with the AN prills. In HFES, on the other hand, an appreciable cooling period is required to drop from the formulation temperature to AT. Gel stability, AN crystal growth, and intimacy of the "redox" (oxidation-reduction) admixture responsible for detonability are all adversely affected by this slow cooling. Even the 32° transition temperature of AN (where the crystal habit changes from the $\beta$ [below] to the $\gamma$ structure [above]) has an influence on sensitiveness, i.e., it hampers stability, when the disperse phase has in it an isoluble liquid sensitizer, in passing through this phase transition.

(d) On the negative side is the fact that CAN is the form of the undissolved AN in the disperse phase when AN prills are used in the metathesis reaction. This could be cured by using FAN or even UFAN in place of prills in the final stages of CFOS, but it adds an extra step, namely, that of forming the FAN or UFAN. A replacement of CAN by FAN is unnecessary in CFES when sensitized with insoluble fuels because the limitation is then not the sensitiveness but rather $V_1^o$.

(e) When insoluble solid or liquid sensitizers are used, the $V_1^o$ limitation imposes a lower limit on UFAP (in order to remain within the slurry state) amounting to about 20±2% in the final CFES. The UFAP has considerable sensitizing quality and is thus very desirable but still the most costly ingredient in many preferred CFES's. In some applications a lower sensitiveness would be desirable if greater economy could be realized. It is not as simple as just diluting the NaP(aq) with water and making up the Sn deficiency to produce the preferred $AN_s/SN_s(aq)$ because this incurs excessive cooling in the metathesis with excess AN. That is, AN and SN both dissolve endothermically in water at −77 and −60 cal/gram, respectively, and exothermicity of the 60NaP(aq)/AN metathesis nearly balances the endothermicity of $AN_s/SN_s(aq)$ formulation when the 60NaP(aq) is used in this metathesis solution formation. This is not so at lower NaP(aq) concentrations. The CFES would be impractical were it not for the favorable heat balance of the 60NaP(aq)/AN metathesis with excess AN. Therefore (except for an indicated small water dilution to about 58% in some climates) the 60NaP(aq)/AN system is preferred, and other methods to reduce UFAP and cost besides diluting the system with water should be used.

CFOS-CN: A simple way to lower the NaP(aq) within the limitation imposed by $V_1^o$ is to use a soluble fuel or oxidizer to extend the dispersion phase. Examples of such fuels are given later in connection with CFES products. Here calcium nitrate (CN) is considered for this purpose. The use of a commerical CN prills (Norsk Hydro or NHCN) by adding it along with the AN in the 60NaP(aq)/AN metathesis has a two-fold advantage: It lowers the 60Nap(aq) requirement and accomplishes a small water dilution without incurring excessive endothermicity (by reason of the exothermicity of the CN dissolution). But it also has a disadvantage of introducing a bivalent ion which tends to lower gel stability. NHCN has approximately the composition 77.5/7.5/15 ($CN/AN/H_2O$). The 60NaP(aq)/AN prills/NHCN prills at the ratio 25.5/59.5/15 lowered the 60NaP(aq) requirement from 31 to 20 percent corresponding to a UFAP minimum of 11.5.

CFOS-M: This is an OS with the preferred $AN_s/SN_s(aq)$ dispersion phase and FAN, UFAN, or both comprising the disperse phase. (With CAN alone as the AN constituent of the disperse phase, this OS would be of little value because, as a diluent for the CFOS, it cuts sensitiveness excessively.) This may be corrected either by adding FAN (made by simply grinding AN prills) or by miling or colloidizing the AN. The simplest and apparently the best way to do this is by homogenizing the $AN_s/SN_s(aq)$-CAN system, e.g., using a "Greerco" grinder or homogenizer. This was done with this system at 20° and $V_1=50$, namely, 46.4% $AN_s/SN_s(aq)$ and 53.6% AN prills. This product remained in the slurry state at 0° C. [with 12.2% water $V_1(0°)=39.9$]. This CFOS-M had a (computed) dispersion phase of 23.42/10.7/12.2 $AN/SN/H_2O$ and 14.4/8.9/12.2 and a disperse phase of 53.6 UFAN and 53.6/9/1.8 UFAN/-FAN/FSN at 20° and 0° C., respectively. With a system such as this, no NaP(aq) at all is needed to achieve a good level of sensitiveness, but its advantage must be weight against the cost of the CFOS on a purely economical basis, i.e., the extra cost of homogenizing against that of 18% or more UFAP. The system $AN_s/SN_s(aq)$-FAN/SAN is likewise good (but not as good) and less costly because grinding to FAN is less costly than grinding to UFAN size.

CFOS-H: A surprising result in the application of this invention was that hot, concentrated AN solutions with fudge points from 50° to 85° C. and to which SN had been added in the correct amount to give $AN_s/SN_s(aq)$ at 20° C. together with 0.1±0.1 (zero to 0.2)% "Petro Ag Special" (surfactant sodium methylnaphthalene sulfonate) could be cooled with stirring or air-"sparging" all the way from the fudge point to 20° C. or below to give an OS having $45 < V_i < 55$, i.e., having essentially the same composition except for the Petro Ag Special (PAS) as in the above CFOS-M. For example, to an 86% AN solution at 90° was added 12 parts of SN and 0.1 parts PAS. The mixture was then cooled with stirring to near AT (below the 32° transition temperature where fluidity increased sharply) to produce a thick (but not too thick to pump) OS. This demonstrated the feasibility of this method of producing a cold AN/SN slurry from hot AN solution. The practical advantage of this system is that hot AN solution is often the most economical source of AN, and the fudge-cooling yields storable CFOS-H without the need for hot-storage facilities. Moreover, the CFES products made therefrom are more sensitive than the corresponding HFES products, i.e., with a given fuel sensitizer, as shown in examples given below. For practical purposes, CFOS-H products with up to 15% rather than the low 12.2% water of the above example may be preferred. For example, to 100 parts of the 83% AN solution was added 16 parts SN and 0.1 parts PAS, and the product cooled with sparging to 20° C. to give a CFOS-H having a dispersion phase of $V_1 = 59.3$ and a disperse phase of 43.5/0.9/0.86 FAN/FSN/PAS. This example utilized the 83% AN solution most generally available and is more readily cooled to ambient temperatures (AT). CFOS-H with 16.3% water, 16.3% SN, and 0.1% PAS have been fudge-cooled in this manner to below 10° C. with nothing but simple, relatively slow stirring.

EXAMPLES OF CFES AND COMPARISONS WITH HEFS

Fuel oil (FO) has been used as the sensitizer for the popular dry blasting agent ANFO since 1955. FO-HFES has also been in commercial use since the early 1960's, but it was not until the early 1970's that it began to be used in large quantities. The initial bulk product (FO-HFES does not have packaged slurry quality) was too insensitive and unstable in sensitiveness to be able to "sleep" in the borehole for more than a few hours. Charges were thus loaded and fired within hours of each other. In spite of many developments directed toward stabilizing FO and other insoluble liquid fuels in HFES (U.S. Pat. Nos. 3,318,740; 3,431,155; 3,485,686; 3,507,718; 3,522,117; 3,695,950; 3,727,350; 3,985,593 and 4,059,449), even yet the "sleeping" quality is only a few days.

EXAMPLE S-1

As a standard by which to compare the cold-formulated explosive slurries of this invention with hot-formulated (commercial) products of prior art, a system with the lowest sensitiveness for a commerically viable HFES was selected, namely, the FO-HFES. Several 5"(d), 30-lb charges were made as follows: To 22 pounds of 64/18/18 AN/SN/$H_2O$ solution at 55° C. was added 50 grams hydroxypropyl guar gum mixed with 6 pounds of AN prills. Then 15 grams PAS and 1000 milliliters FO were incorporated, the product gassed with sodium nitrite/acetic acid and then packaged for sensitiveness tests. The sensitiveness tests gave $\rho_c = 1.08(20°,1)$ (meaning a critical density of 1.08 g/cc at 20° C. after one day) and F-1.0(0°,1) (meaning a failure at a density of 1.0 g/cc, 0° C., and after one day storage). Sensitiveness deterioration in this FO-HFES was observed after five days normal (AT) storage.

Example S-2:

To 22 pounds of the 78% AN solution having about the same fudge point as the above 64/18/18 solution (about 50° C.) was added six pounds AN prills into which 50 grams guar gum had been mixed. After thickening, 15 grams PAS and 935 milliliters FO were incorporated, and the product cross-linked and gassed with sodium nitrite/acetic acid as before. The sensitiveness test gave the result F-1.05(20°,1). (Other studies showed it had a critical density of 1.06 g/cc in 6" diameter charges of 36" in length). These results, together with computed composition and $V_1$ data, are summarized in Table I along with similar types of data for nine examples of CFES products of this invention.

Example A

The FO-CFES of this invention was easily made with 31.5% (the minimum imposed by the $V_1^o$ limitation) to 35% and more 60NaP(aq), 61.5 to 58% or less AN prills, 6.6±0.2 FO, 0.1 PAS, 0.4±0.1 hydroxypropyl guar gum cross-linked with 0.02±0.005% potassium (pyro)antiomonate, and density controlled. (The density-controlling for the results shown in Table I was effected with sodium nitrite/acetic acid at from 0.8 to 1.2 mol ratio. $CO_2$, expanded perlite ["Ryolex"] and foamed polystyrene were also studied in this system. U.S. Pat. No. 3,382,117; 3,390,030, '031, and '032; 3,449,181, and 3,453,158 are examples of patents describing density control in HFES.)

TABLE I

| Computed Product Data for CFES Examples A-H and (Standard) FO-HFES Products | | | | Dispersion | | | | | | | |
|---|---|---|---|---|---|---|---|---|---|---|---|
| t° C. | | Phase | | Disperse Phase | | | Sensitiveness | | | | |
| Example | ES Type | a | b | % | $V_1$ | $V_1°$ | UF | F | C | L | [$\rho_c$ (g/cc)] |
| S-1 | FO-HF | 45 | 20 | 50.7 | 49 | (40) | — | 23.3 | 20.0 | 6.0 | 1.08 |
| | | | 0 | 38.5 | 41 | | — | 35.5 | 20.0 | 6.0 | (0.94 est.) |
| S-2 | FO-HF | 45 | 20 | 47.7 | 55 | | | 26.7 | 20.0 | 5.6 | <1.05 |
| A | FO-CF | AT | 20 | 50.4 | 52 | 40 | 21.1 | — | 21.9 | 6.6 | 1.34 |
| | | | 0 | 38.6 | 42 | | 21.1 | 11.8 | 21.9 | 6.6 | 1.20 |
| B | Gil-CF | AT | 16 | 54.8 | 58 | 42 | 24.2 | 7.3 | 13.7 | — | 1.24 |
| C | FO-CF-CN | AT | 12 | 58.1 | 52 | (42) | 14.4 | 1.1 | 19.3 | 7.1 | ≧1.24 |
| D | MA-CF | AT | 26 | 54.5 | 64 | 50 | 15.5 | — | 30.0 | — | 1.38 |
| | | | 1 | 42.8 | 54 | | 15.5 | 11.7 | 30.0 | — | 1.20 |
| E | MA-CF-M | 20 | 20 | 48.5 | 60 | | 7.2 | 31.0 | 13.3 | — | ≧1.26 |
| F | MA-CF-M | AT | 20 | 43.6 | 53 | | 35.0 | 21.4 | — | — | ≧1.14 |
| G | MA-CF-H | AT | 17 | 48.8 | 58 | | 6.5 | 32.5 | 12.2 | — | ≧1.31 |
| H | FO-CF-H | 20 | 11 | 55.4 | 60 | | — | 38.6 | — | 6.0 | ≧1.18 |

TABLE I-continued

| Computed Product Data for CFES Examples A-H and (Standard) FO-HFES Products | | | | Dispersion | | | | | | | |
|---|---|---|---|---|---|---|---|---|---|---|---|
| t° C. | | Phase | | Disperse Phase | | | | Sensitiveness | | | |
| Example | ES Type | a | b | % | $V_1$ | $V_1°$ | UF | F | C | L | [$\rho_c$ (g/cc)] |
| I | TO-CF | AT | 20 | 46.0 | 48 | | 18.4 | — | 23.0 | 7.0 | ≧1.30 |

[a]Formulation temperature (AT - ambient temperature not recorded).
[b]Temperature of sensitiveness test.
Values in ( ) are estimates from OS studies.
UF - ultra-fine AP and SN in all cases except F where it was UFAN.
F - Fine AN and SN except in B where it was all fine gilsonite.
C - Coarse AN.
L - FO containing 0.1% PAS or "red" tall oil (Example I).

Example A is represented by at least half of more than a hundred sensitiveness tests, this example being based on the 33.5/60 ratio for 60Nap(aq)/AN. (The $V_1°$ was based on the 31.5% lower limit and on the corresponding OS studies.) Certain of these products had packaged-slurry quality and nearly all of them had bulk-slurry quality based on studies covering more than five months AT (hot-summer to cold-winter) storage, $\rho$(t, age) sensitiveness tests, density-stability studies, water resistance and thermal-cycling tests. Packaged-slurry quality was observed in the FO-CFES made with chromate-free (NaP(aq) and density-controlled with sodium nitrite acetic acid. Products made with $CO_2$ density control retained their sensitiveness but gradually increased in density because $CO_2$ dissolved in FO (such that density-lowering from the ungassed state was lost at 5±2% per day). Products made with 60 NaP(aq) containing "0.1 max" sodium dichromate had bulk slurry quality but not packaged slurry quality. That is, they were essentially normal in water resistance, density and sensitiveness, but the gel texture was less than desirable for long-time storage involving thermal fluctuations.

Sensitiveness of FO-CFES followed, as nearly as could be determined, the linear plot $\rho_c(0°)$ being 1.20, 1.28, and 1.18 g/cc for nitrite gassing, baking soda gassing, and Ryolex, respectively, and the temperature coefficient being about 0.007 g/cc per °C. This was based on the best dividing line between all D's (below) and F's with some D's (above). No loss in sensitiveness was seen in sensitiveness tests up to 150 days of midsummer to winter storage.

While 0.1% Petro Ag Special disperses FO in the FO-CFES, aliphatic alcohols in amounts above about 0.5% do likewise. Using the 5.5/2.0 FO/MA sensitizer and Ryolex 18 density control, for example, duplicate charges formulated at the 60 NaP(aq)/AN ratio of 33.5/60 gave 2D—1.19 (11°,104), even though the MA had probably all evaporated before the end of the 104 days' storage, as seen in studies mentioned below. These and $V_1°$ data show that FO is held in dispersion by tghe UFAP and thickened CFES, not necessarily by the dispersing agent, although the latter is needed for rapid dispersion of FO.

EXAMPLE B

Gilsonite has been used extensively in HFES but never as a sensitizer, rather only as an energizing fuel. This economically attractive, fine-grained solid hydrocarbon has too little sensitizing value to sensitize HFOS to detonability in the sensitiveness test here used or even in 6" diameter charages at any $\rho(t)>1.0(20°)$. Gilsonite has accordingly been used only in conjunction with other sensitizers in the HFES of prior art (U.S. Pat. Nos. 3,882,752; 3,367,805, and 3,713,914). On the other hand, results of a dozen sensitiveness tests with all-gilsonite-sensitized CFES (gil-CFES) gave $\rho_c=1.24(16°)$ at the 60 NaP/AN ratio=37/55, 7.3% gilsonite, 0.4% guar gum, $CO_2$ density control, and a CAN constituent of 13.7%. The product made with chromate-free NaP(aq) had packaged slurry quality, but that with the usual "0.1 max" sodium dichromate was not far behind in quality. The minimum 60 NaP(aq) in this example was 33% corresponding to $V_1(0°)=42$, and two charges were unchanged in quality after 104 days of normal AT storage. Another advantage of the NaP(aq)/AN metathesis for this gil-CFES was that the gilsonite could be added right along with the AN prills going readily into the slurry. In the HFES products of prior art, gilsonite had to be used in a "premix."

Example C

Five FO-CFES-CN charges were tested using the 25/52.5/15 ratio for 60 NaP(aq)/AN/NHCN, 7.0 FO, 0.1 PAS, 0.45% guar gum, and density controlled with sodium/nitrite/acetic acid. Results were D—1.18(1°,6), F—1.3(1°6), 2D—1.24(12°,115), and F—1.33(12°, 115). This product did not have packaged-slurry quality (but had good bulk-slurry quality) by reason of only fair gel quality caused by $Ca^{++}$. The lower limit imposed by $V_1°$ was about 20% 60 NaP(aq) to give 11.5 UFAP but no UFSN by reason of the 2.25% water introduction in the NHCN. (CN does not inhibit AN crystal growth.)

Example D

This is a MA-CFES for which over 30 sensitiveness tests were made and MA evaporation studied. MA is an economical fuel sensitizer considered in the prior art for MA-HFES (U.S. Pat. Nos. 3,465,675 and 3,765,967) which has not enjoyed commercial success because of the high volatility and low flashpoint of MA. In fact, if MA is to be used at all as a sensitizer for slurry explosives, the safe way to do so would seem to be in cold formulations such as MA-CFES. These products were found to have excellent properties except for slow MA evaporation (too fast for packaged slurry but not for bulk slurry applications). The minimum 60 NaP(aq) required with MA sensitizer was 23% (imposed again by the $V_1°$ limitation). In this example 60 NaP(aq)/AN prills at the 25/60.5 ratio was used together with 13.5% MA and 0.6±0.3% guar gum. The sensitiveness test gave $\rho_c=1.38(26°, 2)$ with only the slight aeration with (variable) guar gum content needed for density control and $\rho_c=1.20(1°,2)$ using $CO_2$ density control. An anomalous result [F—1.25(15°,8)] was obtained leading to MA and isoprophl alcohol-evaporation studies showing that MA evaporates at (summer) AT at a high enough rate to account for this failure below the previously established $\rho_c(t)$ line. Approximately the same evaporation loss and effectively the same sensitiveness were observed using 10% isopropyl alcohol and 29.8/58.6 for the 60 NaP(aq)/AN. When 8.1% n-butanol was used as the sensitizer, the result (again with no density control necessary) was D—1.38(20°, 10), but NaP(aq)/AN ratio then had to be higher (33.3/57.6). At any rate, n-butanol did not evaporate in these hot-summer tests.

MA was difficult to use in CFOS because (a) the guar gum thickened the dispersion phase very slowly in the cold, approximately half polar dispersion phase, and (b) the density difference between the dispersion and disperse phases was excessively great. FO-CFES has a favorable density difference between the two phases because the low-density sensitizer (FO) expands the disperse rather than the dispersion phase. MA does just the opposite; it lowers the density of the dispersion pase to 1.1 to 1.2 g/cc (from 1.44 to 1.51 g/cc) for $AN_s/SN_s$(aq) at 0° to 30° C., respectively, without changing appreciably the average density of the disperse phase from that of CFOS. The former difficulty is considerably improved by using less 60 NaP/AN and adding CFOS-M or CFOS-H. $V_1-V_1^o$ remained high in the MA-CFES-M and MA-CFES-H, but because $H_2O$/MA was higher they thickened more readily in the cold slurries. Ethylene glycol, sugars, formamide, monomethylamine nitrate, and many others are better sensitizers than MA in this system but all more costly. Furthermore, NA is a marginal sensitizer for HFES and thus well suited to bring out the advantages of the CFES of this invention. It was therefore used in three additional examples presented below as a constant factor to show certain features of CFOS-M and CFOS-H.

Example E

The 60 NaP(aq)/AN metathesis system at the 11.3/26.4 ratio was added along with 19.8% $AN_s/AN_s$(aq) at 20°,32 (ground) FAN, 0.8 guar gum, and 11.5% MA. The product was then gelled and density controlled with $CO_2$ to give the MA-CFES-M of Table I based on one sensitiveness test: D—1.26(20°, 1). This single charge was made with chromate-free NaP(aq) and appeared to have excellent quality except for the found slow evaporation of MA in storage.

Example F

Two MA-CFES-M charges were made with no UFAP (as an example of UFAN) using the OS 51.9/8.3/8.3 AN/SN/$H_2O$ (homogenized in a Greerco grinder), 19.4 FAN, 11.5 MA, and 0.8 guar gum. The products were then gassed with $CO_2$. The results of the sensitiveness test were 2D—1.14(20°, 7).

Example G

To the 60 NaP(aq)/AN metathesis product at the 10/23.3 ratio and 20° C. was added a CFOS-H having the composition 42/4.4/6.4/0.1 AN/SN/$H_2O$/PAS which had been fudge-cooled with stirring to 28° C. (after which it was permitted to stand unstirred) along with 13% MA and 0.8% guar gum. The charge was then gelled and density controlled with sodium nitrite/acetic acid. The total water content was thus only 10.4. The sensitiveness test gave D—1.31(17°,1).

Example H

To check FO dispersion stability in CFOS-H, a 27½-pound charge of this OS was made using the 67.3/16.3/16.3/0.1 AN/SN/$H_2O$/PAS composition by starting with an 80.5% AN solution, adding the SN and PAS at 65° C. and fudge-cooling to 10° C. At this point it was still pumpable, indeed, no thicker than it was at 32° just before the AN underwent the $\gamma$-$\beta$ transition point. The CFOS-H was then permitted to stand overnight in a room at 20° C. Then the settled FAN was (easily) stirred back into suspension in the $AN_s/Sn_s$(aq), 50 grams guar gum, and 820 grams FO dispersed (requiring no longer than the time required for the guar gum to thicken the solution) and the charges gelled with K-(pyro)antimonate and density-controlled with sodium nitrite/acetic acid (two examples) and Ryolex 40-1 in a third. The results were: D—1.18(11°,6), F—1.36(11°,6), and D—1.10(12°,6), respectively.

Example I

A low-melting tall oil (TO) was used to make TO-CFES. Tall oil is of interest in this invention because it offers several valuable alternatives of application and promotes gassing with sodium nitrite or baking soda. It may either be used as such, as in this example, or to form a solid fuel by making it into an alkali metal salt where it is only partly soluble to distribute itself in both phases, or a Ca-salt by precipitating it in ultrafine form by introducing the sodium-salt into a solution containing the stoichiometric amount of CN (to avoid appreciable $Ca^{++}$ in solution to reduce the quality of the gel. Other saturated and unsaturated fatty acids, some of the aliphatic acids, and sodium phenoxide should also be useful in the same ways. In this example the 60NaP(aq)/AN metathesis was carried out at the 30/62.6 ratio and 7% "red⇄ tall oil added along with 0.4% guar gum. The product was then gelled and gassed with sodium nitrite to give a TO-CFES with the sensitiveness-test result: D—1.30(20°,8).

Examples A to I (summarized in Table I) are all based on marginal (FO, TO, MA) and submarginal (gilsonite) fuel sensitizers as far as the HFES of prior art is concerned. These examples, however, show that none of these sensitizers is marginal in the CFES of this invention. Obviously $\rho_c$ will be increased appreciably or the critical diameter at $\rho=1.1$ g/cc lowered appreciably by employing a CFOS having primarily UFAP and FAN in the disperse phase in combination with a high-quality sensitizer, e.g., dinitrotoluene (DNT), nitrobenzene, or an explosive sensitizer like monomethylaminenitrate, TNT, or the like. As a final example, therefore, a DNT-CFES-H was made using essentially the same composition as was used in preparing a DNT-CFES-H for which a sensitiveness test result was D—1.51(20°,2) and a propagation test had been made by the method of U.S. Pat. No. 4,084,993 showing a complete detonation of a 1.5" diameter charge at 1.1 g/cc using a 30-gram cast 50/50 pentolite booster.

Example J

A fuel-rich emulsion of DNT was first prepared by dispersing 18 parts molten DNT in 18.5 parts of a 78% AN solution at 58° C. containing 0.1 parts guar gum and 0.1 parts acetic acid. (The melting point of the DNT here used was 56° and the fudge point of the solution about 50°.) This product was then quench-cooled with a CFOS made from the product of the 64NaP(aq)/AN metathesis at the 30/33.1 ratio and at 15° C. along with 0.4% additional guar gum. The product was then gelled but no density-control agent used. Essentially the same result was obtained in the sensitiveness test as for the DNT-HFES, i.e., D—1.52(20°,5) in this case. While this did not provide a basis for showing any sensitiveness advantage of the DNT-CFES over the corresponding HFES, the former was easier to formulate and had a better gel texture. It also had a theoretically better disperse phse constitution. Both had a computed $V_1(20°)=56$, but, by reason of the use of 63.5% cold material to quench-cool 36.5% hot emulsion in the CFES compared with 20% AN prills to quench-cool 80% of the DNT emulsion in the HFES, the disperse phase should have had an average particle size appreciably less than in the HFES case. The disperse phase comprised approximately the 15.8/10/18 UFAP/-FAN/DNT composition in the CFES, but water content (14.8%) was sufficient in both cases that all the AN prills added to the HFES should have gone into solution at the quench temperature (about 48° C.) in the HFES. The DNT was noticeably finer in the CFES.

Having described my invention, what is claimed and desired to be secured by Letters Patent is:

1. Aqueous explosive slurries formulated at ambient temperatures comprising:

(a) A dispersion phase having a minimum volume in the range 40 to 60% of the slurry consisting of an aqueous solution saturated with ammonium nitrate and containing sodium nitrate at or near saturation, with or without other soluble fuel, soluble oxidizer, or both, (b) A disperse phase having a maximum volume of 60 to 40% of the total slurry consisting of from zero to 50% ultra-fine (colloidal size) ammonium perchlorate, from zero to 5% ultra-fine or fine recrystallized sodium nitrate, and from 50 to 100% ammonium nitrate in colloidal (milled), fine ground, fine recrystallized or coarse form, or combinations thereof, at least 30% of the disperse phase being ultra-fine (colloidal) oxidizer solids, (c) Soluble insoluble, partially soluble, or combinations thereof of fuel sensitizer(s) sufficient to oxygen-balance the explosive slurry at zero to negative oxygen percentage (based on $CO_2$ and $H_2O$ as the products of detonation) and to sensitize it at or above a level of detonability whereby it propagates completely in an unconfined 5" diameter polyethylene-packaged charge at least six diameters in length with a 2" diameter×4" long case 50/50 pentolite booster or its equivalent with the explosive slurry having a density above 1.10 g/cc at 20° C. or above 1.0 at zero ° C.

(d) Thickened and gelled with guar gum, a cross-linking agent therefor and density controlled to the desired density by gas generated chemically or introduced mechanically by aeration using variations in the guar gum content, or by incorporation of a low-density porous or aerated solid.

2. The explosive slurry of claim 1 in which the ultra-fine component of the disperse phase is either predominately or entirely ultra-fine ammonium perchlorate produced by a metathesis reaction of aqueous sodium perchlorate with solid ammonium nitrate with the latter in sufficient excess to saturate the resulting ammonium nitrate/sodium nitrate solution, and contribute from zero to all of the undissolved ammonium nitrate of the disperse phase in the form of coarse, prill-size ammonium nitrate, or from all to none fine ground or recrystallized ammonium nitrate.

3. An explosive slurry of claim 1 in which from zero to all of the solids of the disperse phase and from zero to all of the aqueous solution of the dispersion phase comprise fine, recrystallized ammonium nitrate and the corresponding mother liquor, respectively, prepared by fudge-cooling with stirring at 30° C. or below starting with a hot, concentrated ammonium nitrate solution having a fudge point of 50° C. or higher to which sodium nitrate has been added in an amount up to the water content of the solution.

4. An explosive slurry of claim 1 in which from zero to all of the ammonium nitrate of the disperse phase is fine, ground or ultra-fine, milled ammonium nitrate.

5. An explosive slurry of claim 1 in which a part to all the ammonium nitrate of the disperse phase and part to all of the dispersion phase comprises a cold-milled or homogenized slurry of ammonium nitrate and sodium nitrate.

6. An explosive slurry of claim 3 in which up to 0.2% solution methylnaphthalene sulfonate has been added to assist sodium nitrate as a crystal-growth inhibitor for ammonium nitrate.

7. An explosive slurry of claim 2 in which calcium nitrate prills in an amount up to 20% is added with the ammonium nitrate prills.

8. An explosive slurry of claim 1 in which the sensitizer is an insoluble liquid fuel.

9. An explosive slurry of claim 1 in which the sensitizer is fuel oil dispersed with up to 0.2% sodium methylnaphthalene sulfonate.

10. An explosive slurry of claim 1 in which the sensitizer is a solid, granular fuel.

11. An explosive slurry of claim 1 in which the sensitizer is gilsonite.

12. An explosive slurry of claim 1 in which the sensitizer is a lower aliphatic acid alcohol.

13. An explosion slurry of claim 1 in which the sensitizer is ethylene glycol.

14. An explosive slurry of claim 1 in which the sensitizer is an explosive per se such as coarse TNT or monomethylamine nitrate.

15. An explosive slurry of claim 1 in which the sensitizer is a saturated or unsaturated fatty acid, the sodium, salt, or the calcium salt thereof.

* * * * *